US009206949B2

(12) United States Patent
Lin et al.

(10) Patent No.: US 9,206,949 B2
(45) Date of Patent: Dec. 8, 2015

(54) RETRACTABLE END-CAP FOR LED TUBE

(71) Applicant: Lightel Technologies, Inc., Renton, WA (US)

(72) Inventors: Ching-Feng Lin, Taipei (TW); Chia-Yiu Maa, Bellevue, WA (US); Chun-Te Yu, Bellevue, WA (US); Pai-Sheng Shen, Bellevue, WA (US)

(73) Assignee: Lightel Technologies, Inc., Renton, WA (US)

( * ) Notice: Subject to any disclaimer, the term of this patent is extended or adjusted under 35 U.S.C. 154(b) by 50 days.

(21) Appl. No.: 14/135,319

(22) Filed: Dec. 19, 2013

(65) Prior Publication Data

US 2015/0146418 A1 May 28, 2015

(30) Foreign Application Priority Data

Nov. 27, 2013 (CN) ..... 2013 1 0636570

(51) Int. Cl.

| | |
|---|---|
| ***F21V 21/00*** | (2006.01) |
| ***F21K 99/00*** | (2010.01) |
| ***F21V 25/04*** | (2006.01) |
| ***H01R 33/08*** | (2006.01) |
| ***H01R 33/96*** | (2006.01) |
| *F21Y 101/02* | (2006.01) |

(52) U.S. Cl.

CPC ..... *F21K 9/175* (2013.01); *F21V 25/04* (2013.01); *H01R 33/0836* (2013.01); *H01R 33/96* (2013.01); *F21Y 2101/02* (2013.01)

(58) Field of Classification Search

CPC ..... F21K 9/17; F21K 9/175; F21V 25/04; F21V 19/008; F21V 19/0085; F21V 25/00; F21V 25/02

USPC ..... 439/188, 226–244; 200/51.09

See application file for complete search history.

(56) References Cited

U.S. PATENT DOCUMENTS

2007/0242466 A1* 10/2007 Wu et al. ..... 362/362
2012/0099322 A1* 4/2012 Simon et al. ..... 362/249.02

* cited by examiner

*Primary Examiner* — Evan Dzierzynski
*Assistant Examiner* — Zachary J Snyder
(74) *Attorney, Agent, or Firm* — Han IP Corporation

(57) ABSTRACT

Embodiments of an end-cap for an LED tube are described. In one aspect, an end-cap for an LED tube may include an end-cap housing, at least one elastic component, and a connecting assembly. The end-cap housing may include at least one power pin thereon and configured to connect to an external power source. The elastic component may reside inside the end-cap housing. The end-cap housing may connect to a first end of the connecting assembly via an extendable connection and a second end of the connecting assembly opposite to the first end thereof connects to a body of the LED tube through at least one power connector. The power connector may connect to the at least one power pin when the elastic component is pressed. The power connector may remain separate from the at least one power pin when the elastic component is not pressed.

12 Claims, 4 Drawing Sheets

RETRACTABLE END-CAP FOR LED TUBE

CROSS REFERENCE TO RELATED PATENT APPLICATION

The present disclosure claims the priority benefit of Patent Application No. 201310636570.5 filed on Nov. 27, 2013 with the State Intellectual Property Office of China.

BACKGROUND

1. Technical Field

The present disclosure relates to the field of luminaires and, more particularly, to a retractable end-cap of a lighting tube.

2. Description of the Related Art

When a fluorescent tube lamp in a linear lighting fixture is retrofitted with a light-emitting diode (LED) tube, line voltage of 120V or 277V or higher is applied directly to the lamp-holders of the fixture and to the end-caps of the LED tube. If the LED tube employs double-end wiring, when one end of the LED tube connects with the power source, the other end of the LED tube instantly becomes live with electricity. This represents an electrical shock hazard for the installer of the LED tube.

One approach provides an LED tube wherein each of the two end-caps of the LED tube contains an extruded, spring-based safety switch. Before installation, the safety switch is not engaged and thus the bi-pins on the end-cap remain disconnected from the internal electric circuit of the LED tube. During installation, when one end-cap of the LED tube is inserted into the lamp-holder of a linear fixture, the external power source connects to the bi-pins on the end-cap, and at the same time the safety switch is pressed, thus connecting the bi-pins on the end-cap to the internal electric circuit of the LED tube. However, since the bi-pins of the remaining end-cap of the LED tube have not yet been inserted into the other lamp-holder on the linear fixture, the remaining safety switch is not engaged and therefore the remaining end-cap remains disconnected from both the external power source and the internal electric circuit of the LED tube. At this time, the installer can still safely touch the bi-pins of the disconnected end-cap with their bare hands without any risk of electrical shock. There are, however, two drawbacks with the inventive concept of the present disclosure. Firstly, when the lamp-holder loosens over time, the extruded, spring-based safety switch on the end-cap may not be properly engaged to connect the bi-pins to the internal circuit when the LED tube is installed into a linear fixture, resulting in poor connection between the LED tube and the external power source. Secondly, the length of the linear fixture varies. If an LED tube with the extruded, spring-based safety switch is inserted into a linear fixture that is slightly too long, the extruded, spring-based safety switch on the end-cap may not be properly engaged to connect the bi-pins to the internal circuit, resulting in poor connection between the LED tube and the external power source. If the linear fixture is shorter than the LED tube, it is not possible to insert the LED tube into the fixture.

Another approach provides an LED tube where a spring-based, floating end-cap is used on the LED tube. The bi-pins of the end-cap connect to the internal circuit of the LED tube. Before installation, the bi-pins are hidden inside the floating end-cap, and thus there is no risk of the installer making contact with the bi-pins. When the tube is inserted into a linear fixture, the spring-based, floating end-cap is pressed and retracts towards the center of the tube, thus exposing and enabling the bi-pins to connect to the external power source. This second approach solves the problem with the extruded, spring-based safety switch disclosed in the first approach mentioned above, where poor connection arises due to a loosened lamp-holder. However, this spring-based, floating end-cap design still does not solve the problem of differences in the length of the linear fixture, given the fact that the length of the LED tube with the floating end-caps is fixed. Moreover, the floating end-caps present another challenge; namely, the installer cannot see the bi-pins during installation because they are hidden inside the end-cap until the end-cap is pressed. As such, the installer needs to press both end-caps at the same time during installation to expose and insert the bi-pins into the lamp-holders. This is a very difficult task to perform when installing a 4-ft or 5-ft LED tube.

SUMMARY

In one aspect, an end-cap of LED tube may include an end-cap housing, at least one elastic component, and a connecting assembly. The end-cap housing may include at least one power pin thereon and configured to connect to an external power source. The at least one elastic component may reside inside the end-cap housing. The end-cap housing may connect to a first end of the connecting assembly via an extendable connection and a second end of the connecting assembly opposite to the first end thereof connects to a body of the LED tube through at least one power connector. The power connector may connect to the at least one power pin when the elastic component is pressed. The power connector may remain separate from the at least one power pin when the elastic component is not pressed.

In some embodiments, the connecting assembly may include at least one screw and at least one groove inside the end-cap housing along a longitudinal axis of the LED tube. An upper half of the screw near a screw head of the at least one screw may have no screw thread. The at least one screw may reside inside the at least one groove. A bottom half of the at least one screw may fasten the end-cap housing onto the connecting assembly.

In some embodiments, the power connector may include an elastic cylindroid.

In some embodiments, the power connector may be retractable in a direction along the longitudinal axis of the LED tube, and a retracting range of the power connector may be between 1 and 10 mm approximately.

In some embodiments, the power connector may contain a spring therein.

In some embodiments, when the at least one elastic component is not pressed, a distance of separation between the power connector and the at least one power pin may be between 2 and 10 mm approximately.

In some embodiments, the at least one elastic component may include a spring.

The claims and advantages will be more readily appreciated as the inventive concept becomes better understood by reference to the following detailed description and the accompanying drawings showing exemplary embodiments, in which like reference symbols designate like parts. For clarity, various parts of the embodiments in the drawings are not drawn to scale.

BRIEF DESCRIPTION OF THE DRAWINGS

The accompanying drawings are included to aid further understanding of the present disclosure, and are incorporated in and constitute a part of the present disclosure. The drawings illustrate a select number of embodiments of the present disclosure and, together with the detailed description below, serve to explain the principles of the present disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED EMBODIMENTS

Overview

Various implementations of the present disclosure and related inventive concepts are described below. It should be acknowledged, however, that the present disclosure is not limited to any particular manner of implementation, and that the various embodiments discussed explicitly herein are primarily for purposes of illustration. For example, the various concepts discussed herein may be suitably implemented in a variety of LED tubes having different form factors and light output.

The present disclosure provides a new end-cap for the LED tube. It ensures that an LED tube is activated only when both end-caps of the LED tube are inserted into the linear fixture sockets, thus protecting the installer from electrical shock during installation. The present disclosure also eliminates the drawbacks of the previous approaches and increases the safety and usability of the LED tube equipped with the new end-cap.

EXAMPLE IMPLEMENTATIONS

Figure 1:
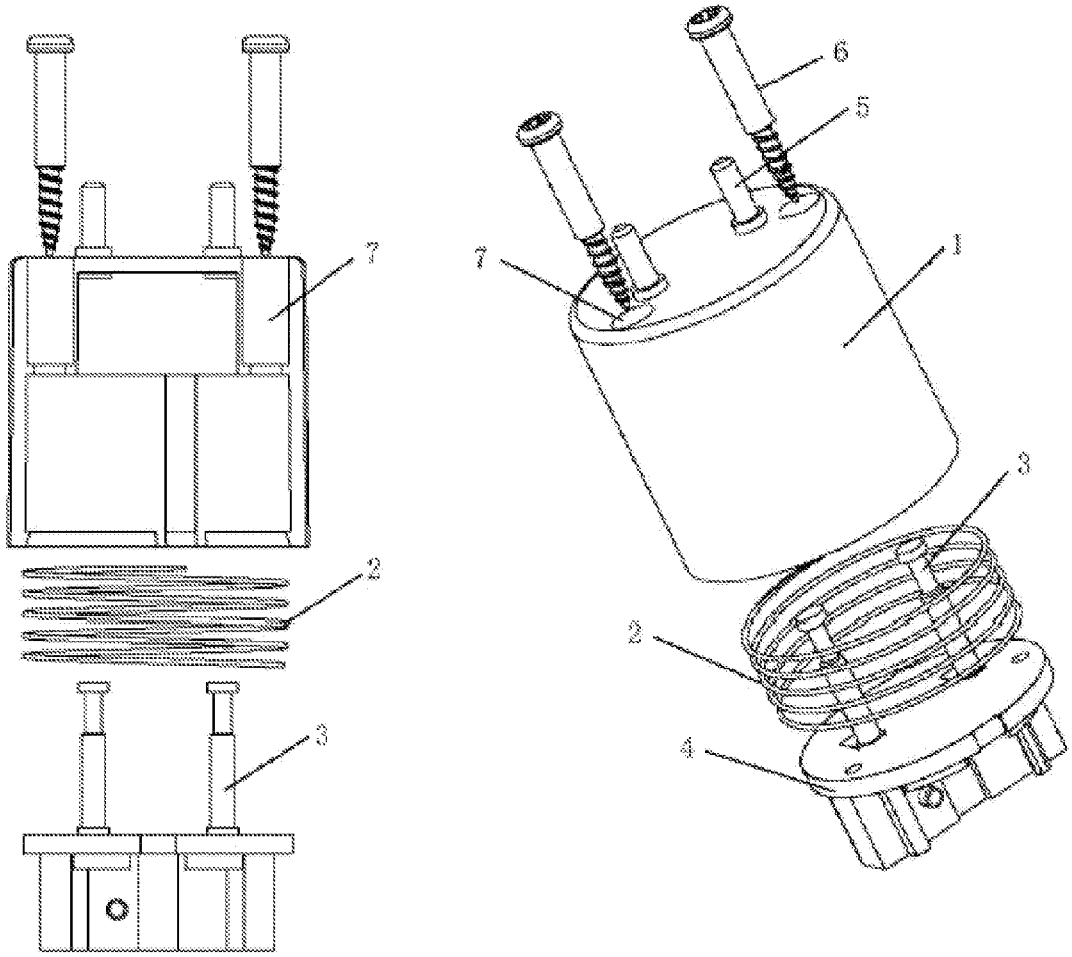
FIG. 1 schematically depicts an embodiment of the present disclosure.
Figure 2:
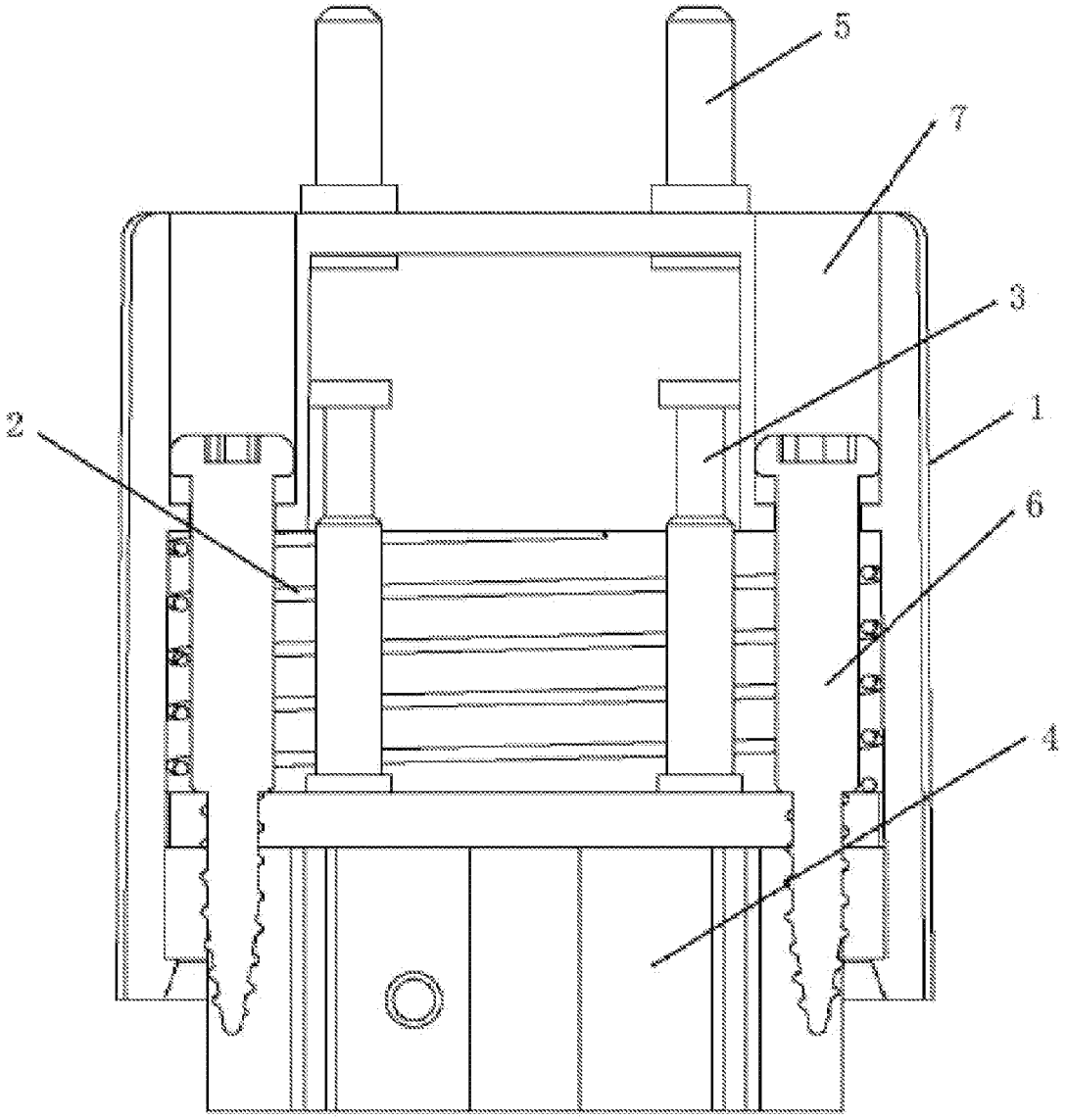
FIG. 2 schematically depicts the cross-section of an embodiment of the present disclosure when the end-cap housing is not pressed.

FIG. 1 illustrates one non-limiting example of an LED tube end-cap according to one embodiment of the present disclosure. The end-cap comprises of one end-cap housing 1, one elastic component 2 consisting of a spring, and one connecting assembly 4. There are two pins 5 on the end-cap housing 1. The elastic component 2 resides inside the end-cap housing 1. The connecting assembly 4 includes two screws 6. On the upper half of the screw 6 near the screw head there is no screw thread. There are two grooves 7 inside the end-cap housing 1 along a longitudinal axis of the LED tube and the screws 6 reside inside the grooves 7. The bottom half of the screw 6 fastens the end-cap housing 1 onto the connecting assembly 4. When the end-cap housing 1 is pressed along the longitudinal axis of the LED tube, the end-cap housing 1 slides along the upper half of the screws 2 and moves in the direction of the longitudinal axis of the LED tube. There are two power connectors 3 at the bottom of the connecting assembly 4. When the spring 2 is pressed, the two power connectors 3 connect to the two pins 5 on the end-cap housing 1, and when the spring 2 is not pressed, the two power connectors 3 remain separate from the two pins 5, as shown in FIG. 2.

Figure 3:
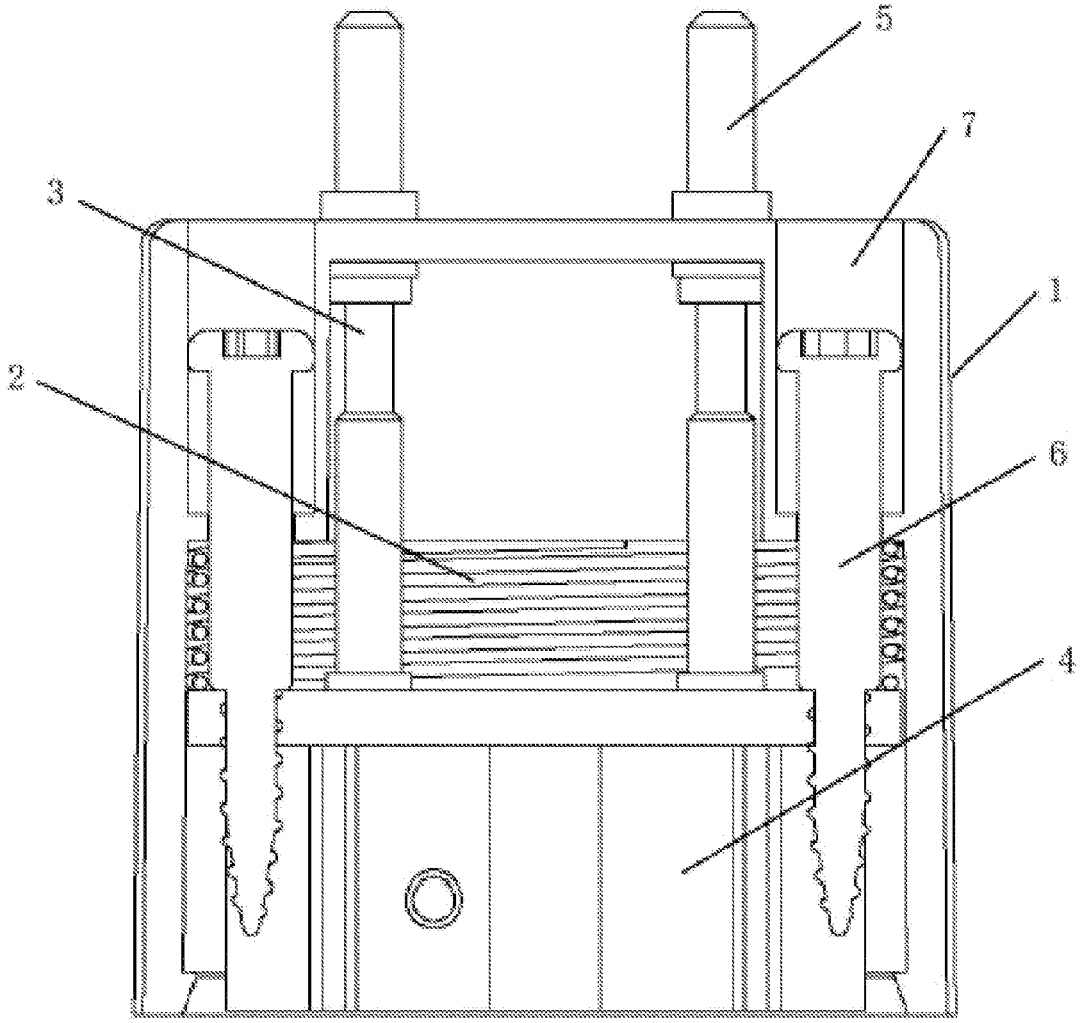
FIG. 3 schematically depicts the cross-section of an embodiment of the present disclosure when the end-cap housing is pressed.

In actual use, one side of the connecting assembly connects with the LED tube body. During the installation of an LED tube with the end-cap described in the present disclosure into a linear fixture, the end-cap housing 1 is pressed, thus causing the end-cap housing to slide along the longitudinal axis of the LED tube and press down on the spring 2. As a result, the two power connectors 3 connect to the two pins 5, as shown in FIG. 3. When the LED tube is taken out of the linear fixture, the pressure on the end-cap housing 1 is removed and the spring 2 pushes the end-cap 1 away from the LED tube, thus separating the two power connectors 3 from the two pins 5.

Figure 4:
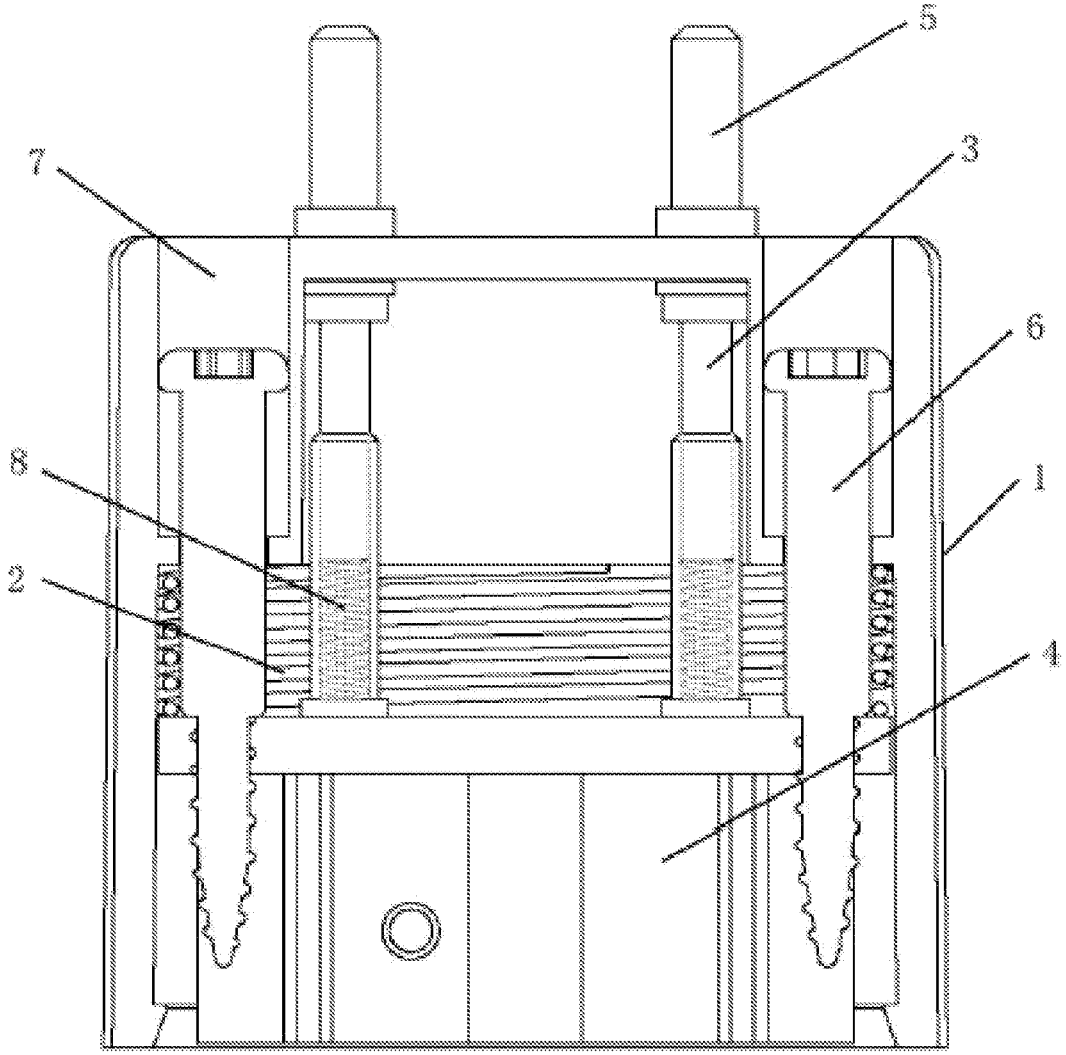
FIG. 4 schematically depicts the cross-section of another embodiment of the present disclosure when the end-cap housing is pressed, and the power connector contains a spring inside for adjusting the total length of the LED tube when the power connector is pressed.

FIG. 4 illustrates the cross-section of another embodiment of the present disclosure when the end-cap housing 1 is pressed. In addition to the components and structure shown in FIG. 1, the two power connectors 3 in FIG. 4 contain a spring 8 that has a 1-10 mm expansion range. After the end-cap housing 1 is pressed along the longitudinal axis of the LED tube until the two pins 5 connect to the two power connectors 3, additional pressure to the end-cap housing 1 causes the two power connectors 3 to retract between 1-10 mm along the longitudinal axis of the LED tube, resulting in an adjustment of the total length of the LED tube. This enables the installation of an LED tube into linear fixtures that vary slightly in length.

While the present disclosure has been described and illustrated in its preferred embodiments, it should be understood that departure therefrom may be made within the scope of the present disclosure, which is not limited to the specific details disclosed herein.

Additional and Alternative Implementation Notes

Although the techniques have been described in language specific to certain applications, it is to be understood that the appended claims are not necessarily limited to the specific features or applications described herein. Rather, the specific features and examples are disclosed as non-limiting exemplary forms of implementing such techniques.

As used in this application, the term "or" is intended to mean an inclusive "or" rather than an exclusive "or." That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more," unless specified otherwise or clear from context to be directed to a singular form.

For the purposes of this disclosure and the claims that follow, the terms "coupled" and "connected" may have been used to describe how various elements interface. Such described interfacing of various elements may be either direct or indirect.

What is claimed is:

1. An end-cap of a light-emitting diode (LED) tube, comprising:

an end-cap housing;

a power connector;

a first elastic component; and a connecting assembly, wherein:

the end-cap housing includes at least one power pin thereon and configured to connect to an external power source, the end-cap housing connects to a first end of the connecting assembly via an extendable connection and a second end of the connecting assembly opposite to the first end thereof connects to a body of the LED tube through the power connector, the first elastic component resides inside the end-cap housing and is configured to render and separate a connection between the power connector and the at least one power pin, the power connector connects to the at least one power pin when the first elastic component is pressed, the power connector remains separate from the at least one power pin when the first elastic component is not pressed, and the power connector comprises a second elastic component configured to adjust a length of the LED tube when the second elastic component is pressed.

2. The end-cap of claim 1, wherein the connecting assembly comprises:

at least one screw; and at least one groove inside the end-cap housing along a longitudinal axis of the LED tube, wherein:

an upper half of the screw near a screw head of the at least one screw has no screw thread, the at least one screw resides inside the at least one groove, and a bottom half of the at least one screw fastens the end-cap housing onto the connecting assembly.

3. The end-cap of claim 1, wherein the second elastic component of the power connector comprises an elastic cylindroid.

4. The end-cap of claim 3, wherein the second elastic component enables the power connector to retract in a direction along the longitudinal axis of the LED tube, and wherein a retracting range of the power connector is between 1 and 10 mm approximately.

5. The end-cap of claim 3, wherein the second elastic component is a spring.

6. The end-cap of claim 2, wherein the second elastic component of the power connector comprises an elastic cylindroid.

7. The end-cap of claim 6, wherein the second elastic component enables the power connector to retract in a direction along the longitudinal axis of the LED tube, and wherein a retracting range of the power connector is between 1 and 10 mm approximately.

8. The end-cap of claim 6, wherein the second elastic component is a spring.

9. The end-cap of claim 1, wherein when the first elastic component is not pressed, a distance of separation between the power connector and the at least one power pin is between 2 and 10 mm approximately.

10. The end-cap of claim 2, wherein when the first elastic component is not pressed, a distance of separation between the power connector and the at least one power pin is between 2 and 10 mm approximately.

11. The end-cap of claim 1, wherein the first elastic component comprises a spring.

12. The end-cap of claim 2, wherein the first elastic component comprises a spring.

* * * * *